US006969239B2

(12) United States Patent
Grant et al.

(10) Patent No.: US 6,969,239 B2
(45) Date of Patent: Nov. 29, 2005

(54) APPARATUS AND METHOD FOR DAMPING VIBRATIONS BETWEEN A COMPRESSOR STATOR VANE AND A CASING OF A GAS TURBINE ENGINE

(75) Inventors: Carl Grant, Cincinnati, OH (US); David Curr Douglas, Hamilton, OH (US); Stephen Rex Payling, Cincinnati, OH (US); James Vota, Milford, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/260,633

(22) Filed: Sep. 30, 2002

(65) Prior Publication Data

US 2004/0062652 A1 Apr. 1, 2004

(51) Int. Cl.[7] ..... F01D 5/30

(52) U.S. Cl. ..... 416/220 R; 415/209.3; 415/119; 415/173.4

(58) Field of Search ..... 415/220 R, 119, 415/209.3, 213.1, 214.1, 200, 209.2, 209.4, 139; 416/500, 190, 220 R; 52/396

(56) References Cited

U.S. PATENT DOCUMENTS

| | | | | | |
|---|---|---|---|---|---|
| 4,305,696 | A | * | 12/1981 | Pask | 415/209.2 |
| 4,522,559 | A | * | 6/1985 | Burge et al. | 415/220 R |
| 4,580,946 | A | | 4/1986 | Bobo | 416/190 |
| 4,872,812 | A | | 10/1989 | Hendley et al. | 416/500 |
| 4,897,021 | A | | 1/1990 | Chaplin et al. | 415/173.7 |
| 4,940,386 | A | * | 7/1990 | Feuvrier et al. | 415/209.3 |
| 5,052,890 | A | | 10/1991 | Roberts | 416/500 |
| 5,141,400 | A | * | 8/1992 | Murphy et al. | 416/204 A |
| 5,269,110 | A | * | 12/1993 | Morrison et al. | 52/220.8 |
| 5,429,477 | A | * | 7/1995 | Sikorski et al. | 415/119 |
| 5,429,479 | A | | 7/1995 | Cordier | 415/209.3 |
| 5,584,654 | A | * | 12/1996 | Schaefer et al. | 415/209.3 |
| 5,681,142 | A | | 10/1997 | Lewis | 415/209.3 |
| 5,820,343 | A | | 10/1998 | Kraft et al. | 416/500 |
| 5,848,874 | A | | 12/1998 | Heumann et al. | 415/189 |
| 6,206,631 | B1 | * | 3/2001 | Schilling | 415/173.4 |
| 6,343,912 | B1 | | 2/2002 | Manteiga et al. | 415/139 |
| 6,409,470 | B2 | * | 6/2002 | Allford et al. | 415/119 |
| 6,409,472 | B1 | | 6/2002 | McMahon et al. | 415/119 |
| 6,425,736 | B1 | * | 7/2002 | McMahon et al. | 415/173.4 |
| 6,450,766 | B1 | | 9/2002 | Honda | 415/191 |
| 2002/0090302 | A1 | * | 7/2002 | Norris et al. | 415/119 |
| 2002/0162627 | A1 | * | 11/2002 | Dunlap | 156/307.1 |

FOREIGN PATENT DOCUMENTS

| | | | | |
|---|---|---|---|---|
| GB | 2255138 A | * | 10/1992 | F01D/5/10 |

* cited by examiner

*Primary Examiner*—Thai-Ba Trieu
(74) *Attorney, Agent, or Firm*—William Scott Andes; James P. Davidson

(57) ABSTRACT

A stator vane assembly for a compressor of a gas turbine engine, including a stator vane having an inner portion and an outer portion, a platform attached to the outer portion of the stator vane, a casing for the gas turbine engine, wherein the outer platform of the stator vane is attached to the casing in a manner so that an open area is defined therebetween, and a member positioned within the defined open area for damping vibrations transmitted from the casing to the outer platform.

21 Claims, 6 Drawing Sheets

APPARATUS AND METHOD FOR DAMPING VIBRATIONS BETWEEN A COMPRESSOR STATOR VANE AND A CASING OF A GAS TURBINE ENGINE

BACKGROUND OF THE INVENTION

The present invention relates generally to stator vanes in compressors of a gas turbine engine and, in particular, to the damping of vibrations transmitted to such stator vanes from the case of the engine.

It has been found that the case of a gas turbine engine vibrates at various modal frequencies during engine operation. These modal vibrations typically have a wide range of mode shapes, as well as different levels of displacements. It will be appreciated that the fixed stator vanes for the low pressure compressor and/or the high pressure compressor of the engine are generally attached to the engine case. This may be accomplished, for example, by sliding the stator vanes into rails supplied on the inner surface of the case or by capturing a flange between a split-line in the case. In both instances, at least some of the vibration energy of the engine case is transmitted to the stator vanes. Since the individual stator vanes and/or the shroud systems for such stator vanes can vibrate at frequency modes which are substantially synchronous with the case modes, the potential for wear damage and/or high cycle fatigue damage is created.

In order to prevent such potential damage, gas turbine engines in the prior art have employed a variety of solutions. One solution has been to redesign the engine case to remove the potentially damaging modes of vibration. Another solution has been to redesign the stator vanes or the vane/shroud system to remove the vibration modes which are synchronous with the case vibration modes. Damping material and other vibration damping devices have also been added in the shroud/vane tip area to damp the vibrations experienced by such stator vanes, as evidenced in U.S. Pat. No. 4,872,812 to Hendley et al. and U.S. Pat. No. 6,343,912 to Manteiga et al. Still another solution has been to add a mechanical damper spring to the base of the stator vane, as seen in U.S. Pat. No. 5,681,142 to Lewis. None of these solutions, however, has been seen to positively effect a change in the vibrations experienced by the stator vanes from the engine casing.

Accordingly, it would be desirable for a stator vane assembly to be developed which damps the vibrations from the engine case to the stator vanes of the compressor. It is also desirable for the stator vane assembly to be easily assembled and disassembled to facilitate manufacturing and repair.

BRIEF SUMMARY OF THE INVENTION

In a first exemplary embodiment of the invention, a stator vane assembly for a compressor of a gas turbine engine is disclosed as including a stator vane having an inner portion and an outer portion, a platform attached to the outer portion of the stator vane, a casing for the gas turbine engine, wherein the outer platform of the stator vane is attached to the casing in a manner so that an open area is defined therebetween, and a member positioned within the defined open area for damping vibrations transmitted from the casing to the outer platform.

In a second exemplary embodiment of the invention, a stator vane assembly for a compressor of a gas turbine engine is disclosed, wherein the gas turbine engine includes a split-line casing having first and second circumferential flanges surrounding the compressor. The stator vane assembly includes a stator vane having an inner portion and an outer portion, an outer platform attached to the outer portion of the stator vane, a flange extending from the outer platform which is positioned between and attached to the first and second circumferential flanges of the split-line casing so that an open area is defined between the stator vane outer platform and the casing, and a member positioned within the defined open area of the casing for damping vibrations transmitted from the casing to the outer platform.

In accordance with a third embodiment of the invention, a stator vane assembly for a compressor of a gas turbine engine is disclosed where the gas turbine engine includes a casing surrounding the compressor having a plurality of rail members positioned along an inner surface thereof. The stator vane assembly includes a stator vane having an inner portion and an outer portion, an outer platform attached to the outer portion of the stator vane, a pair of end members extending from the outer platform which are positioned within and attached to the rail member of the casing so that an open area is defined between the stator vane outer platform and the casing, and a member positioned within the defined open area for damping vibrations transmitted from the casing to the outer platform.

In accordance with a fourth aspect of the present invention, a method of damping vibrations from an engine casing to a stator vane of a compressor connected to the casing is disclosed as including the following steps: positioning an outer platform of the stator vane with respect to the casing so as to define an open area therebetween; providing a damping member within the defined open area; and, attaching the outer platform to the casing. The casing may have a split-line configuration so that first and second circumferential flanges are mated together, wherein the outer platform is attached to the casing by means of a flange extending therefrom which is positioned between and connected to the first and second circumferential flanges. Alternatively, the casing may have a clam shell configuration so that first and second axial flanges are mated together, wherein the outer platform is attached to the casing by means of a rail member incorporated into an inner surface of the casing.

DETAILED DESCRIPTION OF THE INVENTION

Figure 1:
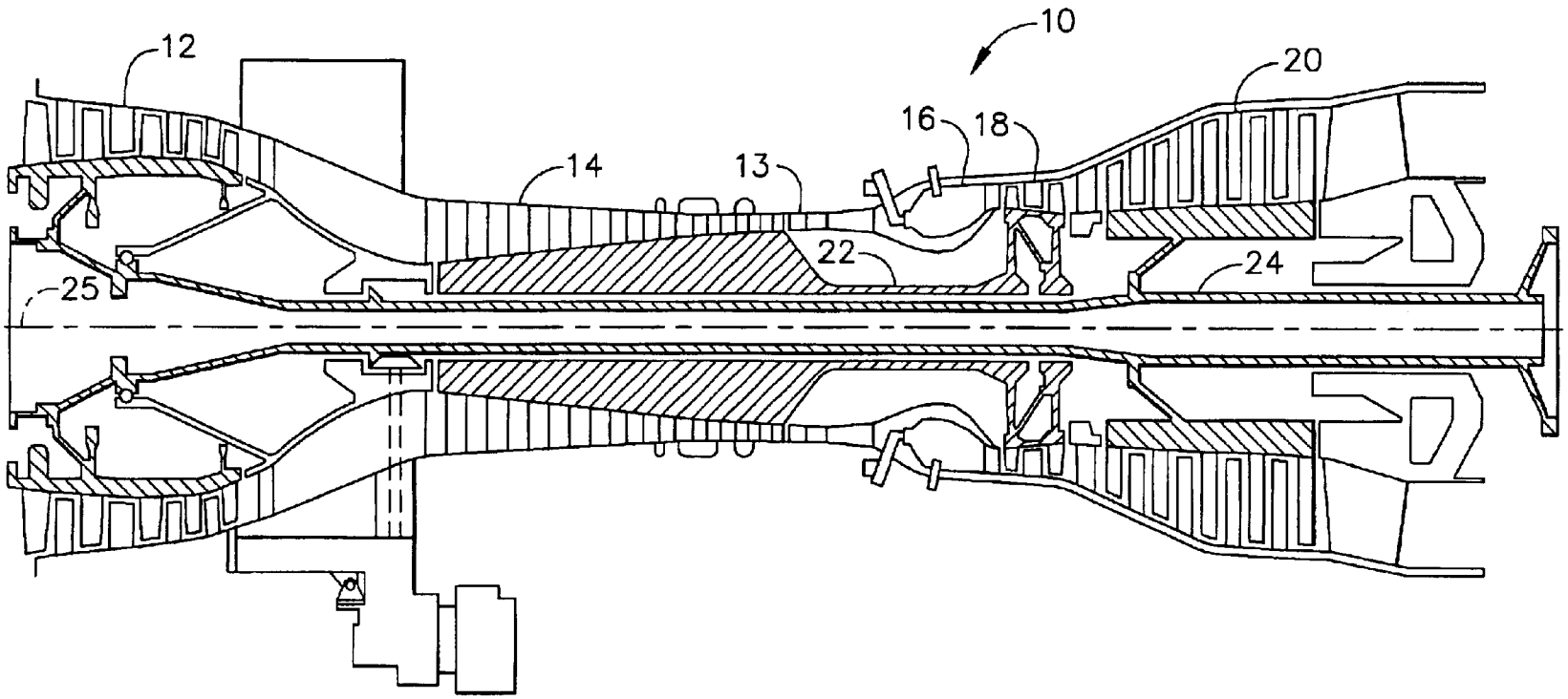
FIG. 1 is a longitudinal cross-sectional view of an exemplary gas turbine engine including a compressor with a stator vane assembly of the present invention.

Referring now to the drawings in detail, wherein identical numerals indicate the same elements throughout the figures, FIG. 1 depicts an exemplary gas turbine engine identified generally by reference numeral 10. Gas turbine engine 10 is typically utilized in marine and industrial applications, and includes in serial arrangement a low pressure compressor 12, a high pressure compressor 14, a booster compressor 13, a combustor 16, a high pressure turbine 18 and a low pressure turbine 20. It will be seen that a first shaft 22 connects high pressure turbine 18 and high pressure compressor 14 while a second shaft 24 connects low pressure turbine 20 and low pressure compressor 12. A longitudinal axis 25 is provided in FIG. 1 for reference purposes.

Figure 2:
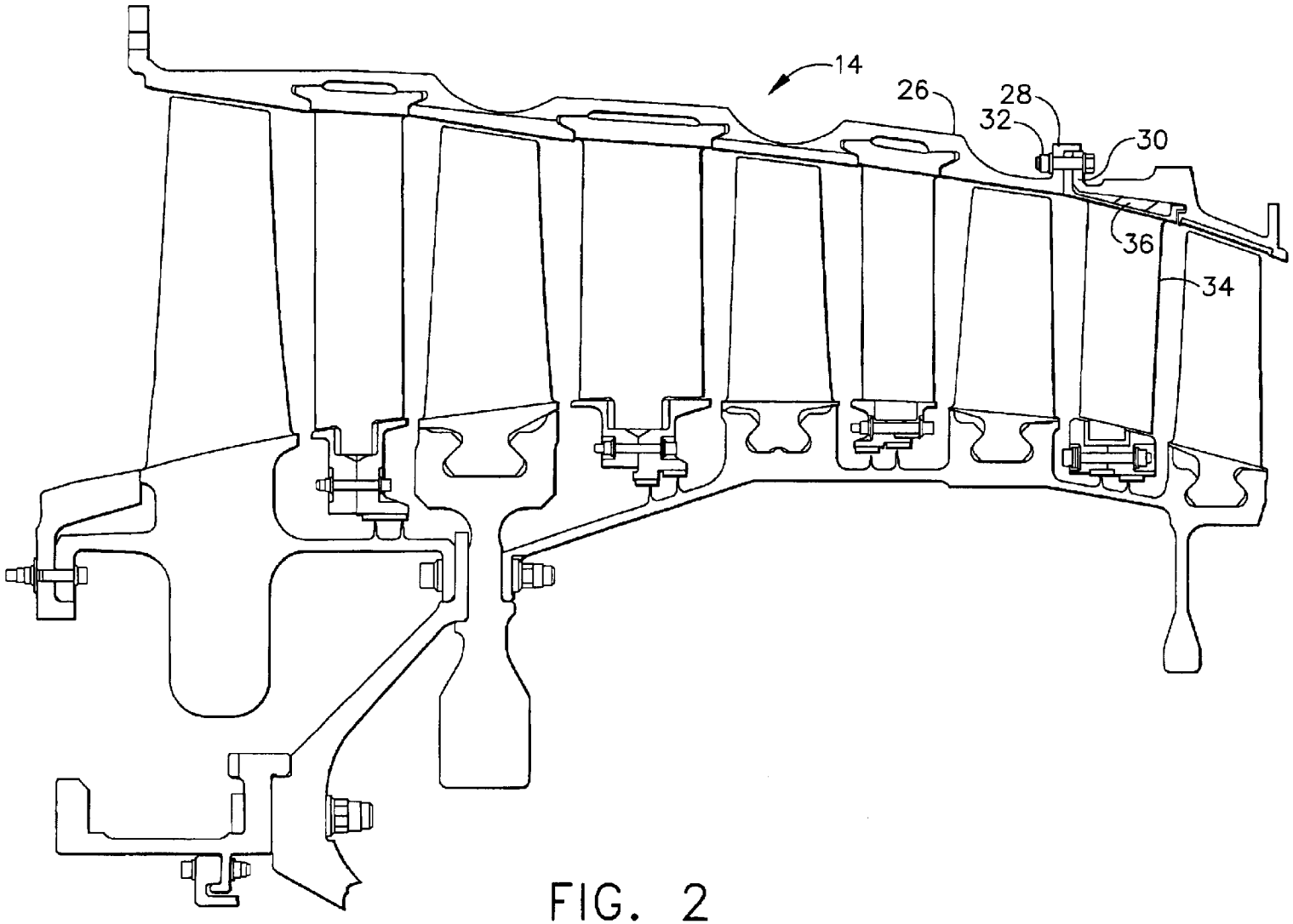
FIG. 2 is a partial cross-sectional view of a split-line compressor depicted in FIG. 1, where an embodiment of the stator vane assembly according to the present invention is shown.

As seen in FIG. 2, gas turbine engine 10 includes a casing 26 which has a split-line configuration at an axial position adjacent high pressure compressor 14. This is evident from a first circumferential flange 28 and a second circumferential flange 30 being connected in abutting relation with a plurality of circumferentially spaced pins 32 or other similar devices connecting such flanges. It will be noted that a particular stage of stator vanes for high pressure compressor 14 (one stator vane 34 being shown) is positioned immediately downstream of the split-line in casing 26. Due to its proximity to flanges 28 and 30, stator vanes 34 may be more susceptible to the vibrations of casing 26. Such casing vibrations, as explained hereinabove, have a wide range of mode shapes with different levels of displacement. In order to lessen the effect such casing vibrations have on stator vanes 34, a damping member 36 is preferably positioned within an area 38 defined between an outer portion 40 of each stator vane 34 and casing 26.

Figure 3:
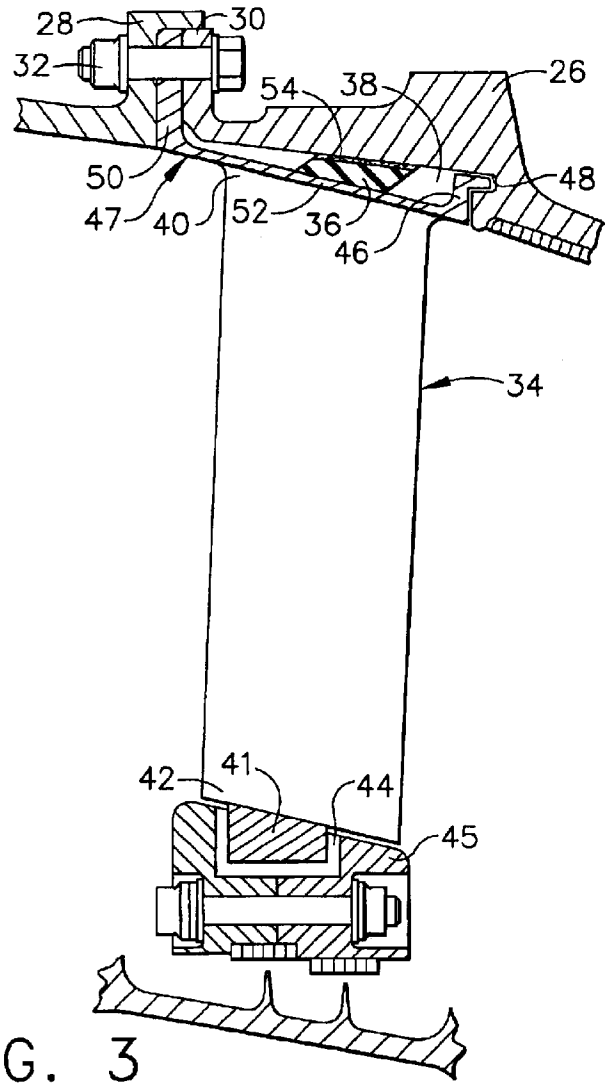
FIG. 3 is an enlarged cross-sectional view of the stator vane assembly depicted in FIG. 2 including a damping member located in a defined area between the stator vane and the engine casing.

More specifically, it will be seen from FIGS. 2 and 3 that a tang 41 of an inner portion 42 of each stator vane 34 is retained within a bushing 44 located in a shroud 45, as is known in the art. Outer portion 40 of each stator vane 34 is attached to a platform 47 which is retained by casing 26, where outer platform 47 preferably includes a first or downstream end 46 having a substantially L-shaped design which is sized to fit within a corresponding slot 48 in casing 26. A second or upstream end 50 of each outer platform 47 preferably is a flange which is configured and sized so as to be inserted between first and second circumferential flanges 28 and 30, respectively, of casing 26 in abutting relation. Each flange 50 also includes at least one opening therethrough so as to permit one or more pins 32 to be inserted therethrough. Each outer platform 47 further includes a middle section 52 connecting upstream end 50 and downstream end 46, where middle section 52 extends substantially parallel to casing 26. Because of the respective configurations for each outer platform 47 and casing 26, it will be appreciated that individual open areas 38 are defined therebetween. In order to dampen vibrations experienced by each outer platform 47 (and therefore each stator vane outer portion 40) from casing 26, a damping member 36 is preferably located within each defined open area 38.

Damping member 36 is preferably constructed of an elastomeric material which preferably is preformed and cured prior to placement within each defined area 38. It will be appreciated that each damping member 36 may be sized to extend within only a portion of each defined area 38 (see FIG. 3) or within substantially all of defined area 38 (see FIG. 4). It will be understood that the elastomeric material will preferably meet certain predefined parameters, including the ability to retain its properties under high temperatures. In particular, the elastomeric material of each damping member 36 will preferably retain its properties in temperatures of at least approximately 300° F., more preferably in temperatures of at least approximately 375° F., and optimally in temperatures of at least approximately 450° F. One example of such elastomeric material is known as red oxide RTV (Room Temperature Vulcanized Rubber) made by GE Plastics of Pittsfield, Mass. Accordingly, damping member 36 is able to provide similar functionality to stator vanes and their platforms positioned within the temperature environments of low compressor 12 and/or booster compressor 13.

Figure 7:
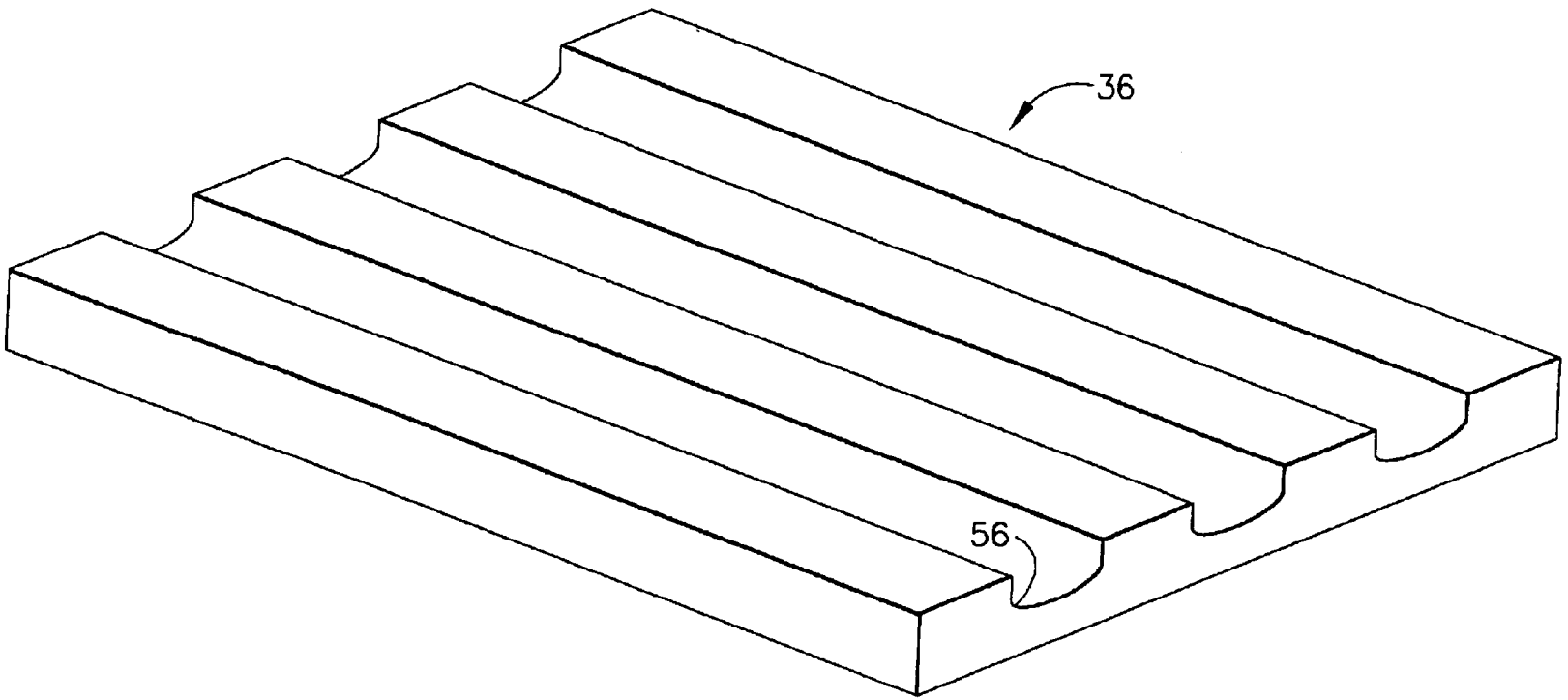

When positioning damping member 36 within a defined area 38, it is preferred that a layer of adhesive 54 be applied thereto so as to maintain it in position while each stator vane 34 and its platform 47 is connected to casing 26. It will be appreciated that adhesive layer 54 may dissolve or burn off once gas turbine engine 10 is in operation, whereby damping member 36 will be either frictionally engaged in defined area 38 or permitted to float therein. As seen in FIG. 7, damping member 36 in a preformed and cured state is shown to be substantially rectangular in shape, although any shape and size may be utilized provided it performs the desired damping function between casing 26 and stator vanes 34. Likewise, a plurality of grooves 56 is preferably formed in damping member 36 in order to provide better flexibility and assembly (see FIG. 7). Orientation of damping member 36 and grooves 56 within each defined area 38, however, is not deemed to be limiting upon the present invention.

Figure 5:
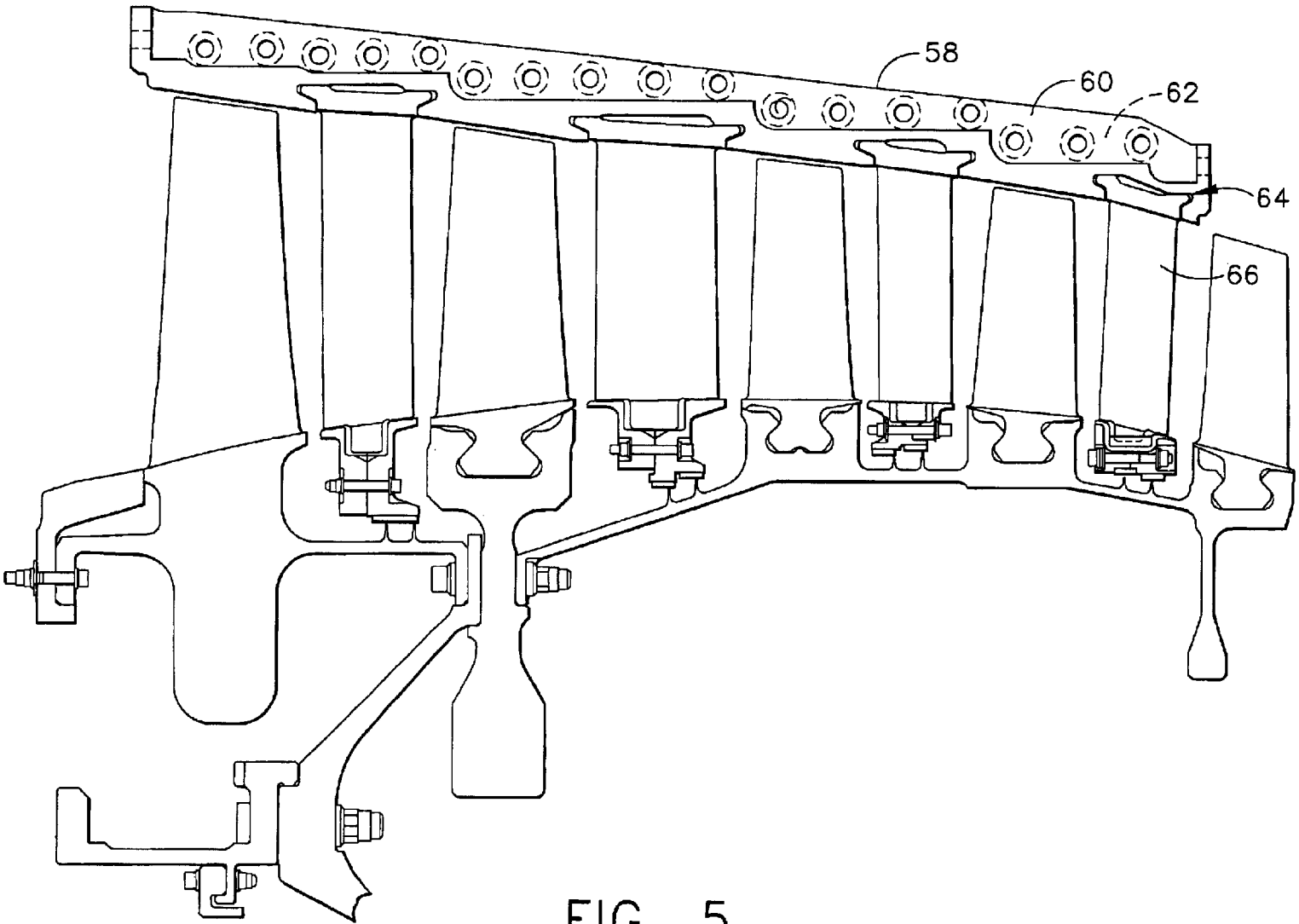
FIG. 5 is a partial cross-sectional view of an engine having an alternative casing configuration, where an embodiment of the stator vane assembly according to the present invention is shown.
Figure 6:
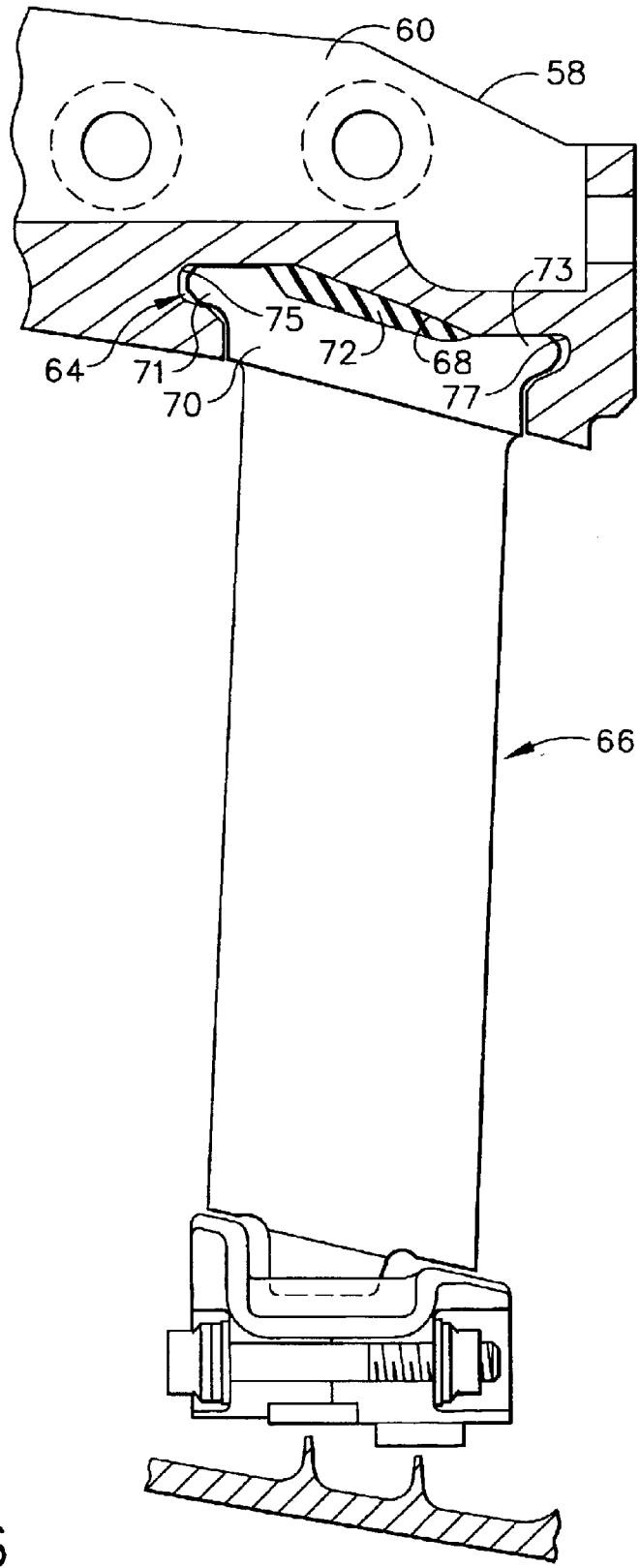
FIG. 6 is an enlarged cross-sectional view of the stator vane assembly depicted in FIG. 5 including a damping member located in a defined area between the stator vane and the engine casing; and, FIG. 7 is an enlarged perspective view of the damping member depicted in FIGS. 3 and 6.

An alternate configuration for the stator vane assembly is depicted in FIGS. 5 and 6, where a casing 58 thereof is continuous in an axial direction but has a pair of flanges 60 and 62 which are connected in a clam shell design at opposite radial ends (only one of which is shown). This casing configuration further provides a plurality of spaced rail members 64 along an inner surface thereof into which a plurality of stator vanes 66 are inserted and retained prior to assembly of casing 58. It will also be appreciated that an open area 68 is accordingly defined between casing 58 and an outer platform 70 for each stator vane 66. Each outer platform 70 further includes a pair of end members 71 and 73 which are received within corresponding pockets 75 and 77 of rail member 64. A damping member 72 like that discussed above is preferably positioned within each defined area 68 so as to damp the vibrations experienced by outer platforms 70 and stator vanes 66 from casing 58. Of course, such damping member 72 will preferably be of a size and shape so as to fit within open area 68 and perform its intended function.

Figure 4:
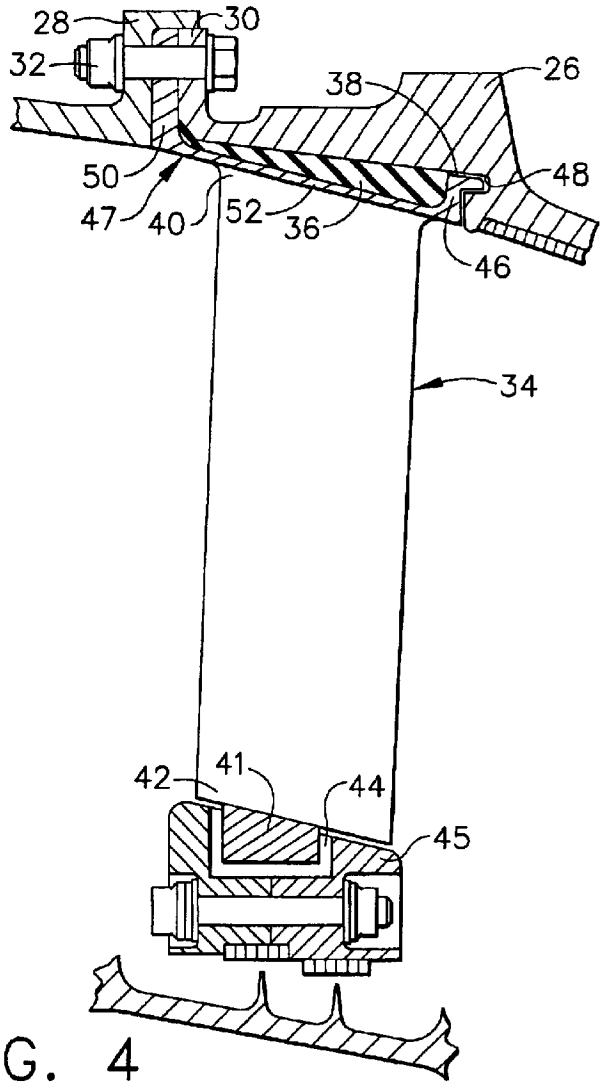
FIG. 4 is an enlarged cross-sectional view of the stator vane assembly depicted in FIG. 2 including an alternative damping member located in a defined area between the stator vane and the engine casing.

Because access to defined areas 68 between casing 58 and each stator vane outer portion 70 is not as simple as for the stage of stator vanes 34 in the split-line casing 26 previously described, it will be appreciated that elastomeric material may alternatively be squeezed into such areas 68, or "in situ," where it is able to cure in place and perform as damping member 72. By providing the elastomeric material in this manner, damping members 72 are able to be more closely sized to open areas 68. This method may also be utilized with split-line casing 26, as seen in FIG. 4.

It will be appreciated that damping members 36 and 72 preferably reduce the vibrations experienced by outer platforms 47 and 70 from casings 26 and 58, respectively, by at least approximately 10%. More preferably, damping members 36 and 72 are able to damp the vibrations from casings 26 and 58 by at least approximately 20% and optimally by at least approximately 30%.

It will further be appreciated that a method of damping vibrations from casing 26 to stator vanes 34 is presented. More specifically, such method includes the steps of positioning outer platforms 47 of stator vanes 34 with respect to casing 26 so as to define an open area 38 therebetween, providing damping member 36 made of an elastomeric material within such defined open areas 38 of casing 26, and securing damping members 36 therein. Thereafter, stator vanes 34 are attached to casing 26 so that outer platforms 47 are retained adjacent to damping members 36 and vibrations from casing 26 are dampened. Prior to such steps, damping members 36 are preferably preformed and cured, including grooves 56 formed therein, and adhesive layer 54 applied to a surface thereof. Outer platforms 47 are attached to casing 26 and maintained in position by means of flanges 50 which extend therefrom and are positioned between opposite flanges 28 and 30 of casing 26.

An alternative method of damping vibrations from casing 58 to stator vanes 68 is also demonstrated. This method includes the steps of positioning outer platforms 70 of stator vanes 66 in rail members 64 incorporated into casing 58 so as to define open areas 68 therebetween and providing damping members 72 made of an elastomeric material within each such defined open area 68. Further, damping members 72 may be squeezed into each defined area 68 and permitted to cure.

Having shown and described the preferred embodiment of the present invention, further adaptations of the stator vane assembly and damping member 36 thereof can be accomplished by appropriate modifications by one of ordinary skill in the art without departing from the scope of the invention. In particular, while damping member 36 is illustrated as being used in a stator vane of high pressure compressor 14 for gas turbine engine 10, it may be utilized with any fixed or stator vane of any compressor. Further, the present invention may be utilized with engine casings have other configurations than that disclosed herein.

What is claimed is:

1. A method of damping vibrations from an engine casing to a stator vane of a compressor connected to said casing, comprising the following stops:

(a) positioning an outer platform attached to an outer portion of said stator vane with respect to said casing so as to define an open area therebetween, wherein said stator vane outer portion does not extend through said platform;

(b) retaining an inner portion of said stator vane in a designated manner;

(c) providing a damping member within said defined open area of said casing; and, (d) attaching said outer platform to said casing.

2. The method of claim 1, said casing having a split-line configuration so that first and second circumferential flanges are mated together, wherein said outer platform is attached to said casing by means of a flange extending therefrom which is positioned between and connected to said first and second circumferential flanges.

3. The method of claim 1, said casing having a clam shell configuration so that first and second axial flanges are mated together, wherein said outer platform is attached to said casing by means of a rail member incorporated into an inner surface of said casing.

4. The method of claim 1, said damping member is made of an elastomeric material.

5. The method of claim 1, further comprising the steps of preforming and curing said damping member prior to providing said damping member within said defined open area.

6. The method of claim 1, further comprising the step of curing said damping member after positioning it within said defined open area.

7. The method of claim 1, further comprising the step of providing an adhesive layer onto a surface of said damping member prior to providing said damping member within said defined area.

8. A stator vane assembly for a compressor of a gas turbine engine, comprising:

(a) a stator vane having an inner portion and an outer portion;

(b) a platform attached to said outer portion of said stator vane, wherein said vane outer portion does not extend therethrough;

(c) a casing for said gas turbine engine, wherein said outer platform of said stator vane is attached to said casing in a manner so that an open area is defined therebetween; and (d) a member positioned within said defined open area for damping vibrations transmitted from said casing to said outer platform;

wherein said vane inner portion is retained in a designated manner.

9. The stator vane assembly of claim 8, wherein said damping member is constructed of an elastomeric material.

10. The stator vase assembly of claim 9, wherein said damping member retains elastomeric properties at a temperature of at least 300° F.

11. The stator vane assembly of claim 8, wherein said damping member is retained within said defined open area by an adhesive layer.

12. The stator vane assembly of claim 8, wherein said damping member is preformed and cured prior to placement within said defined open area.

13. The stator vane assembly of claim 8, wherein said damping member includes a plurality of grooves formed in a surface thereof.

14. The stator vase assembly of claim 8, wherein said casing has a split-line configuration so that first and second circumferential flanges are mated together, said outer platform further comprising a flange located between said first and second circumferential flanges of said casing.

15. The stator vane assembly of claim 8, wherein said dumping member substantially fills said defined open area.

16. The stator vane assembly of claim 8, wherein said outer platform is retained to said casing by means of a rail member positioned along as inner surface of said casing.

17. The stator vane assembly of claim 16, wherein said defined open area is located between said rail member of said casing and said outer platform.

18. A stator vane assembly for a compressor of a gas turbine engine, wherein said gas turbine engine includes a split-line casing having first and second circumferential flanges surrounding said compressor, said stator vane assembly comprising:

(a) a stator vane having as inner portion and an outer portion;

(b) an outer platform attached to said outer portion of said stator vane;

(c) a flange extending from said outer platform which is positioned between and attached to said first and second circumferential flanges of said split-line casing so that an open area is defined between said outer platform and said casing; and (d) a member positioned within said defined open area of said casing for damping vibrations transmitted from said casing to said outer platform.

19. The stator vane assembly of claim 18, wherein said damping member is constructed of an elastomeric material.

20. A stator vane assembly for a compressor of a gas turbine engine, wherein said gas turbine engine includes a clam shell casing with first and second axial flanges mated together surrounding said compressor, said casing having a plurality of rail members positioned along an inner surface thereof, said stator vane assembly comprising:

(a) a stator vane having an inner portion and an outer portion;

(b) an outer platform attached to said outer position of said stator vane, wherein said vane outer portion does not extend therethrough;

(c) a pair of end members extending from said outer platform which are positioned within mid attached to said rail member of said casing so that an open area is defined between said stator vane outer platform and said casing; and (d) a member positioned within said defined open area for damping vibrations transmitted from said casing to said outer platform;

wherein said vane inner portion is remained in a designated manner.

21. The stator vane assembly of claim 20, wherein said damping member is constructed of an elastomeric material.

* * * * *